US007677691B2

(12) United States Patent
Kinase et al.

(10) Patent No.: US 7,677,691 B2
(45) Date of Patent: Mar. 16, 2010

(54) DROPLET JETTING APPLICATOR AND METHOD OF MANUFACTURING COATED BODY

(75) Inventors: Atsushi Kinase, Yokohama (JP); Hiroshi Koizumi, Hiratsuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 741 days.

(21) Appl. No.: 11/535,314

(22) Filed: Sep. 26, 2006

(65) Prior Publication Data

US 2007/0216721 A1 Sep. 20, 2007

(30) Foreign Application Priority Data

Mar. 15, 2006 (JP) ..... P2006-070501

(51) Int. Cl.
*B41J 2/165* (2006.01)

(52) U.S. Cl. ..... 347/29; 347/30; 347/32

(58) Field of Classification Search ..... 347/29, 347/30, 32, 33
See application file for complete search history.

(56) References Cited

U.S. PATENT DOCUMENTS 4,853,717 A * 8/1989 Harmon et al. ..... 347/29
5,270,738 A 12/1993 Takahashi et al.
6,540,322 B2 * 4/2003 Usui et al. ..... 347/29
2006/0132556 A1 6/2006 Koizumi et al.
2006/0187253 A1 8/2006 Sato et al.

FOREIGN PATENT DOCUMENTS

| | | |
|---|---|---|
| EP | 0 535 686 A2 | 4/1993 |
| JP | 4-250063 | 9/1992 |
| JP | 2004-174845 | 6/2004 |
| JP | 2005-305869 | 11/2005 |

* cited by examiner

*Primary Examiner*—Shih-wen Hsieh
(74) *Attorney, Agent, or Firm*—Oblon, Spivak, McClelland, Maier & Neustadt, L.L.P.

(57) ABSTRACT

A droplet jetting applicator includes: a droplet jetting head which freely moves and includes a nozzle surface with a plurality of nozzles formed, from which droplets are jetted; a suction section which sucks the droplets jetted by the droplet jetting head from a facing position facing the nozzle surface; a support/transfer section which supports the suction section, freely moves together with the droplet jetting head, and moves the supported suction section to the facing position and a non-facing position which is apart from the facing position; and an exhaust section which evacuates the suction section to give the suction section a suction force.

6 Claims, 3 Drawing Sheets

DROPLET JETTING APPLICATOR AND METHOD OF MANUFACTURING COATED BODY

CROSS REFERENCE OF THE RELATED APPLICATION

This application is based upon and claims the benefit of priority from the prior Japanese Patent Application No. 2006-70501, filed on Mar. 15, 2006; the entire contents of which are incorporated herein by reference.

BACKGROUND OF THE INVENTION

1. Field of the Invention

The present invention relates to a droplet jetting applicator which jets droplets to an application object and a method of manufacturing a coated body using the droplet jetting applicator.

2. Discussion of the Background

A droplet jetting applicator is usually used to manufacture various types of displays such as a liquid crystal display, an organic electroluminescence display, an electron-emitter display, a plasma display, and an electrophoretic display.

The droplet jetting applicator includes a droplet jetting head (for example, an inkjet head) which jets droplets (for example, ink) from a plurality of nozzles to an application object. Such a droplet jetting applicator causes droplets to land on a substrate as the application object by means of the droplet jetting head to form rows of dots of a predetermined pattern, thus manufacturing a coated body, for example, such as a color filter or a black matrix (a frame of the color filter). At this time, a substrate holding table on which the substrate is placed and the droplet jetting head move relatively.

In such a droplet jetting applicator, ink at tips of the nozzles coagulates and clogs the nozzles during a non-droplet jet operation such as transportation of the substrate or an alignment operation, or foreign articles such as dust adhere around the tips of the nozzles. Moreover, even during a droplet jet operation, splashed ink and the like adhere to a nozzle surface. This causes bad jet such as non-jet or curved flight of the droplets.

To prevent such clogging of the nozzles and adherence of foreign articles around the tips of the nozzles, therefore, a droplet jetting applicator has been proposed, which performs a redundant jet operation to redundantly jet droplets by means of the droplet jetting head. Moreover, in order to remove foreign articles on the nozzle surface, a droplet jetting applicator has been proposed, which blows air onto the nozzle surface while controlling the strength of the airflow (for example, see JP-A No. 2004-174845(KOKAI)).

In the droplet jetting applicator which performs the redundant jet operation, usually, an absorption pad which receives and absorbs droplets jetted by the droplet jetting head is provided in adjacent to a substrate holding table, above which a guide plate supporting and guiding the droplet jetting head is laid. In a maintenance operation, the droplet jetting head is guided by the guide plate to move to the position facing an absorption pad for the redundant jet operation.

However, in the droplet jetting applicator which performs the aforementioned redundant jet operation, it is necessary to make a space for the absorption pad to be placed in adjacent to the substrate holding table, which increases the droplet jetting applicator in size. Especially when the droplet jetting applicator includes a plurality of the droplet jetting heads, it is necessary to arrange the same number of the absorption pads as that of the droplet jetting heads, which increases the droplet jetting applicator in size. Furthermore, in order to move the droplet jetting head to the position facing the absorption pad, the guide plate needs to be extended to the position facing the absorption pad and increases in length. The droplet jetting applicator accordingly increases in size.

Moreover, in the above-described droplet jetting applicator which blows air onto the nozzle surface, the redundant jet operation is not performed, and the air is blown onto the nozzle surface. Accordingly, drying of ink at the nozzle tips is accelerated. The ink at the nozzle tips coagulates, and nozzles are subject to clogging.

SUMMARY OF THE INVENTION

An object of the present invention is to provide a droplet jetting applicator and a method of manufacturing a coated body which can prevent bad jet of droplets with an increase in apparatus size reduced.

According to a first aspect of embodiments of the present invention, there is provided a droplet jetting applicator, which includes a droplet jetting head which freely moves and includes a nozzle surface with a plurality of nozzles formed, through which droplets are jetted; a suction section which sucks the droplets jetted by the droplet jetting head at an facing position opposite to the nozzle surface; a support/transfer section which supports the suction section, freely moves together with the droplet jetting head, and moves the supported suction section to the facing position and a non-facing position which is apart from the facing position; and an exhaust section which evacuates the suction section to give the suction section a suction force.

In accordance with a second aspect of embodiments of the invention, there is provided a method of manufacturing a coated body, which includes jetting droplets to an application object using the droplet jetting applicator according to the aforementioned first aspect.

DETAILED DESCRIPTION OF THE INVENTION

A description is given of an embodiment of the present invention with reference to the drawings.

Figure 1:
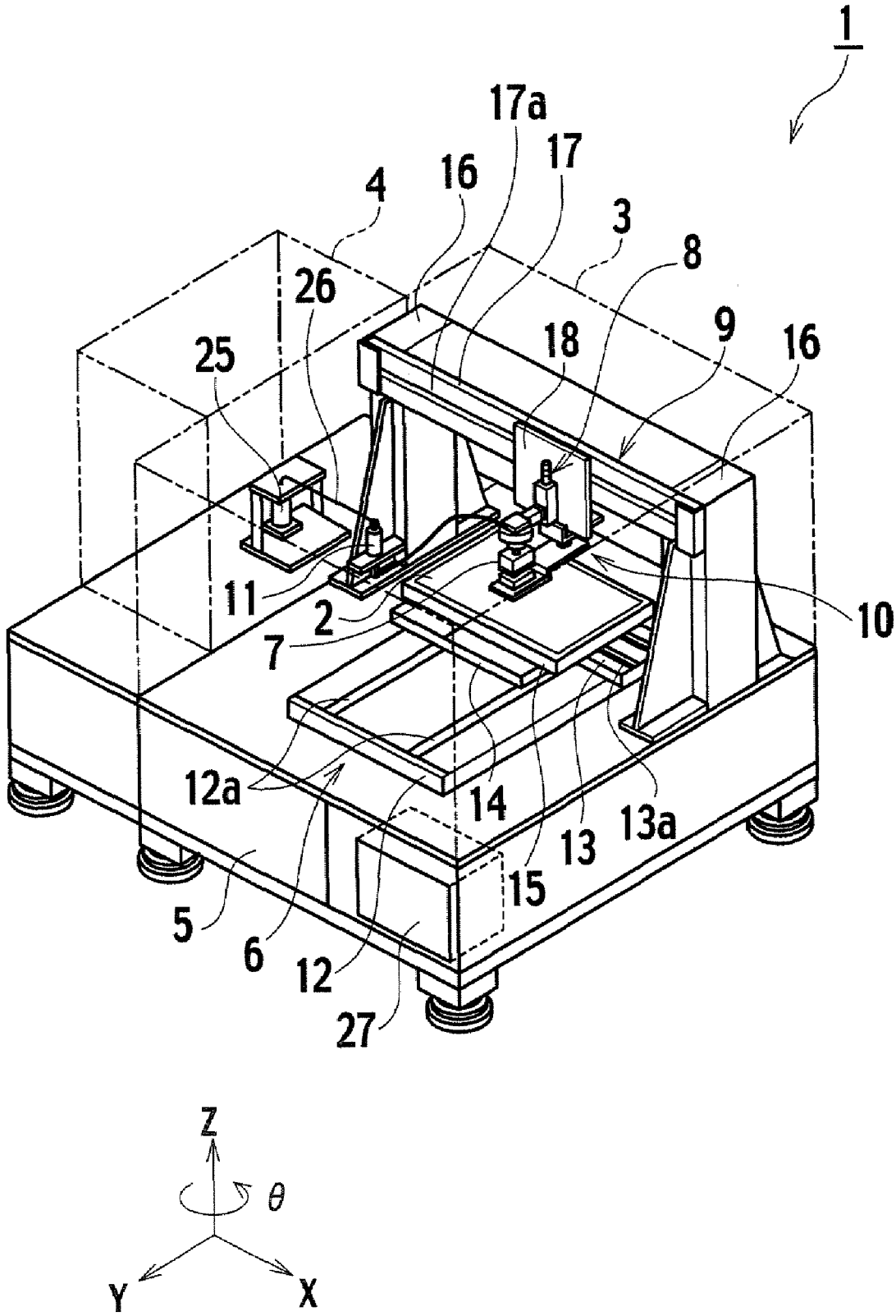
FIG. 1 is a perspective view showing a schematic configuration of a droplet jetting applicator according to an embodiment of the present invention.

As shown in FIG. 1, a droplet jetting applicator 1 according to the embodiment of the present invention includes an ink application box 3 and an ink supply box 4. The ink application box 3 jets and applies droplets to a substrate 2 as an application object. The ink supply box 4 gives ink to the ink application box 3. These ink application box 3 and ink supply box 4 are placed in adjacent to each other and fixed to the upper surface of a pedestal 5.

In the ink application box 3, a substrate transfer mechanism 6, an inkjet head unit 8, a unit transfer mechanism 9, a head maintenance unit 10, and an ink buffer tank 11 are provided. The substrate transfer mechanism 6 holds the substrate 2 and moves the substrate 2 in X-axis and Y-axis directions. The inkjet head unit 8 includes a droplet jetting head 7 jetting ink which is liquid to the substrate 2 as droplets. The unit transfer mechanism 9 moves the inkjet head unit 8 in the X-axis direction. The head maintenance unit 10 cleans the droplet jetting head 7 of the inkjet head unit 8. The ink buffer tank 11 accommodates the ink.

The substrate transfer mechanism 6 includes a Y-axis direction guide plate 12, a Y-axis direction moving table 13, an X-axis direction moving table 14, and a substrate holding table 15, which are stacked on each other. Each of the Y-axis direction guide plate 12, Y-axis direction moving table 13, X-axis direction moving table 14, and substrate holding table 15 is formed into a plate shape.

The Y-axis direction guide plate 12 is fixed to the upper surface of the pedestal 5. In the upper surface of the Y-axis direction guide plate 12, a plurality of guide grooves 12*a* are provided along the Y-axis direction.

The Y-axis direction moving table 13 includes a plurality of protrusions (not shown) which are engaged with the respective guide grooves 12*a* in the lower surface and is provided on the upper surface of the Y-axis direction guide plate 12 so as to move in the Y-axis direction. Moreover, in the upper surface of the Y-axis direction moving table 13, a plurality of guide grooves 13*a* are provided along the X-axis direction. The Y-axis direction moving table 13 is moved along the guide grooves 12*a* in the Y-axis direction by means of a feeding mechanism (not shown) including a feed screw and a drive motor.

The X-axis direction moving table 14 includes protrusions (not shown) which are engaged with the respective guide grooves 13*a* in the lower surface and is provided on the upper surface of the Y-axis direction moving table 13 so as to move in the X-axis direction. The X-axis direction moving table 14 is moved along the guide grooves 13*a* in the X-axis direction by means of a feeding mechanism (not shown) including a feed screw and a drive motor.

The substrate holding table 15 is fixed to the upper surface of the X-axis direction moving table 14. The substrate holding table 15 includes a suction mechanism (not shown) sucking the substrate 2 and fixes and holds the substrate 2 to the upper surface by means of the suction mechanism. The suction mechanism is, for example, an air suction mechanism or the like. The means of holding the substrate 2 may be, instead of the suction mechanism, a gripping mechanism which grips the substrate. The gripping mechanism is, for example, a U-shaped clamp or the like.

The unit transfer mechanism 9 includes a pair of supports 16, an X-axis direction guide plate 17, and a base plate 18. The supports 16 stand on the upper surface of the pedestal 5. The X-axis direction guide plate 17 is connected between upper ends of the supports 16 and extends in the X-axis direction. The base plate 18 is provided for the X-axis direction guide plate 17 so as to move in the X-axis direction and supports the inkjet head unit 8.

The pair of supports 16 are provided so as to sandwich the Y-axis direction guide plate 12 in the X-axis direction. In the front surface of the X-axis direction guide plate 17, a guide groove 17*a* is provided along the X-axis direction.

The base plate 18 includes a protrusion (not shown) which is engaged with the guide groove 17*a* in the back surface and is provided for the X-axis direction guide plate 17 so as to move in the X-axis direction. The base plate 18 is moved along the guide groove 17*a* in the X-axis direction by means of a feeding mechanism (not shown) including a feed screw and a drive motor. To the front surface of the base plate 18, the inkjet head unit 8 is attached.

Figure 2:
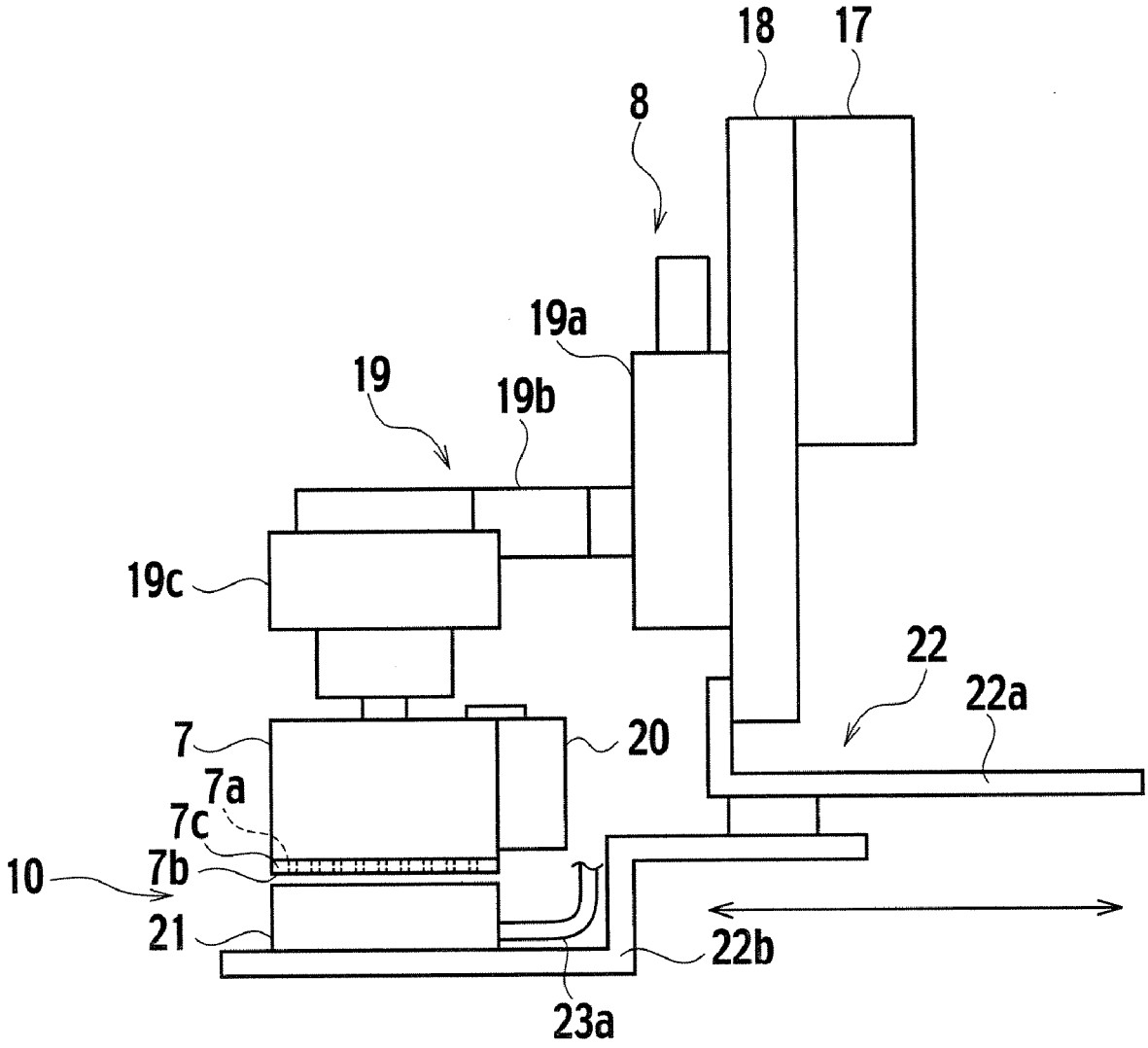
FIG. 2 is a side view showing a schematic configuration of an inkjet head unit and a head maintenance unit which are included in the droplet jetting applicator shown in FIG. 1.

As shown in FIG. 2, the inkjet head unit 8 includes a droplet jetting head 7, a support mechanism 19, and a shooting section 20. The support mechanism 19 supports the droplet jetting head 7 so as to move the droplet jetting head 7. The shooting section 20 shoots alignment marks on the substrate 2.

The droplet jetting head 7 is detachably provided at the bottom of the inkjet head unit 8. The droplet jetting head 7 includes a nozzle surface 7*b* with a plurality of nozzles 7*a* formed, through which droplets are jetted. The nozzle surface 7*b* is the outer surface of a nozzle plate 7*c*. The nozzles 7*a* are provided in a line with a predetermined pitch. Herein, the diameter of the nozzles 7*a* is, for example, about several to several tens of micrometers, and the pitch of the nozzles 7*a* is about several tens to several hundreds of micrometers. On the nozzle surface 7*b*, a liquid repellent film (not shown) to prevent adherence of ink and the like is provided. The droplet jetting head 7 jets droplets (ink droplets) from the nozzles 7*a* to the substrate 2 to form, for example, a color filter pattern or the like on the surface of the substrate.

The support mechanism 19 includes a Z-axis direction transfer mechanism 19*a*, a Y-axis direction transfer mechanism 19*b*, and a θ direction rotation mechanism 19*c*. The Z-axis direction transfer mechanism 19*a* moves the droplet jetting head 7 in a direction vertical to the surface of the substrate 2, that is, in the Z-axis direction. The Y-axis direction transfer mechanism 19*b* moves the droplet jetting head 7 in the Y-axis direction. The θ direction rotation mechanism 19*c* rotates the droplet jetting head 7 in a θ direction. This allows the droplet jetting head 7 to move in the Z- and Y-axis directions and rotate in the θ direction.

The shooting section 20 is fixed to the droplet jetting head 7. The shooting section 20 moves together with the droplet jetting head 7 and shoots the plurality of alignment marks provided on the substrate 2 from positions facing the alignment marks. The shooting section 20 is, for example, a CCD (charge coupled device) camera or the like. Based on each alignment mark shot by the shooting section 20, the position of the substrate 2 on the substrate holding table 15 is corrected.

Figure 3:
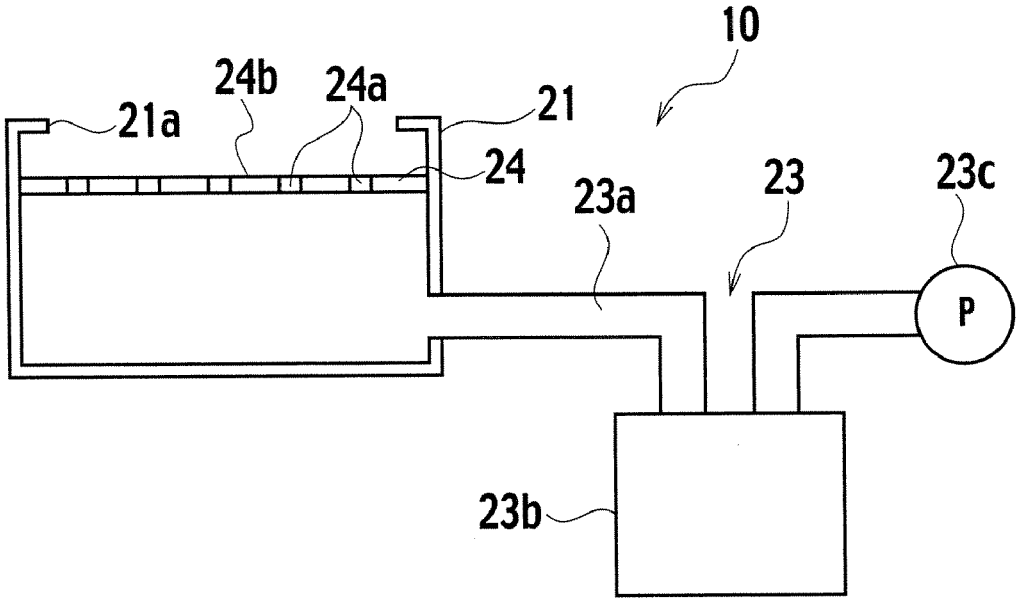
FIG. 3 is a schematic view showing a schematic configuration of the head maintenance unit shown in FIG. 2.

As shown in FIGS. 2 and 3, the head maintenance unit 10 includes a suction section 21, a support/transfer section 22, and an exhaust section 23. The suction section 21 sucks the droplets jetted from the droplet jetting head 7 from a facing position which faces the nozzle surface 7*b*. The support/transfer section 22 supports the suction section 21 and is movable together with the droplet jetting head 7. The support/transfer section 22 moves the supported suction section 21 to the facing position and a non-facing position which is a position apart from the facing position. The exhaust section 23 evacuates the suction section 21 to give the suction section 21 a suction force.

As shown in FIG. 3, the suction section 21 is a suction head shaped in a box, for example, and includes an opening 21*a* through which the droplets jetted from the droplet jetting head 7 are sucked. In the suction section 21, a board material 24 with a plurality of through holes (orifices) 24*a* formed is provided. The sucked droplets pass through the through holes 24*a*. The suction section 21 is supported by the support/transfer section 22 so as to move to the facing position and the non-facing position and moves together with the droplet jetting head 7.

The board material 24 is provided in the suction section 21 so as to cover the opening 21*a*. When the suction section 21 is located at the facing position, an outer surface 24*b* of the board material 24 is a facing surface which faces the nozzle surface 7*b* of the droplet jetting head 7.

Figure 4:
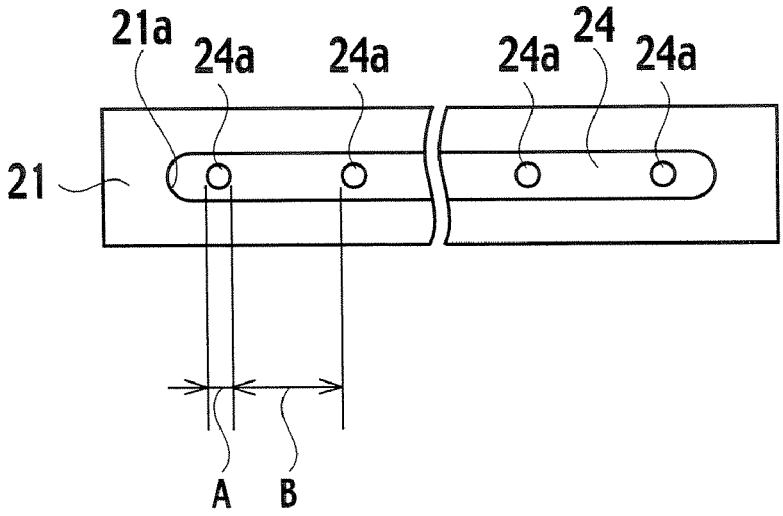
FIG. 4 is a plan view showing a suction section included in the head maintenance unit shown in FIGS. 2 and 3.

As shown in FIG. 4, the through holes 24*a* are provided in a line with a predetermined pitch in the outer surface 24*b* of the board material 24 exposed by the opening 21*a*. Each through hole 24*a* is, for example, shaped into a cylinder. Herein, for example, diameter A of the through holes 24*a* is about 1 to 2 mm, and a pitch interval B thereof is about 5 mm. The plurality of through holes 24*a* being provided in the outer surface 24*b* which is the facing surface of the suction section 21 in such a manner can reduce unevenness in suction speed of the suction section 21 and furthermore reduces variations in the suction force.

As shown in FIG. 2, the support transfer section 22 includes a first support arm 22*a*, a second support arm 22*b*, and a transfer mechanism (not shown) which moves the second support arm 22*b*. The first support arm 22*a* is fixed to the base plate 18. The second support arm 22*b* is provided for the first support arm 22*a* so as to move in the Y-axis direction and supports the suction section 21.

The first support arm 22*a* is fixed to the base plate 18 and supports the second support arm 22*b* so as to move the same in the Y-axis direction. The second support arm 22*b* is moved in the Y-axis direction by the transfer mechanism and locates the suction section 21 to the facing and non-facing positions. The transfer mechanism is a feeding mechanism including a feed screw and a drive motor or the like. The thus structured support/transfer section 22 allows the suction section 21 to move to the facing and non-facing positions.

As shown in FIG. 3, the exhaust section 23 includes an exhaust pipe 23*a*, a waste tank 23*b*, and a suction pump 23*c*. The exhaust pipe 23*a* is connected to the side face of the suction section 21. The waste tank 23*b* is provided in the middle of the exhaust pipe 23*a*. The suction pump 23*c* sucks gas within the suction section 21 through the exhaust pipe 23*a*. The exhaust section 23 evacuates the suction section 21 from under the board material 24 to give the suction section 21 the suction force.

The exhaust pipe 23*a* is connected to the suction section 21 near the bottom of the side face. The exhaust pipe 23*a* communicates with the suction pump 23*c* through the waste tank 23*b*. The waste tank 23*b* is provided inside the pedestal 5 and is a tank accommodating the droplets sucked by the suction section 21 as waste liquid. The suction pump 23*c* is provided inside the pedestal 5 and connected to the inside of the suction section 21 through the exhaust pipe 23*a* with the waste tank 23*b* interposed therebetween. The suction pump 23*c* sucks gas within the suction section 21 through the exhaust pipe 23*a* to evacuate the same. The suction section 21 is thus evacuated, and the suction force is given to the suction section 21.

During a non-droplet jet operation including wait for transportation of the substrate 2 or the operation of shooting the alignment marks on the substrate 2, the above head maintenance unit 10 moves the second support arm 22*b* of the support/transfer section 22 and locates the suction section 21 on the second support arm 22*b* to the facing position. Thereafter, the head maintenance unit 10 drives the suction pump 23*c* of the exhaust section 23 to suck by means of the suction section 21 the droplets jetted from the droplet jetting head 7. The head maintenance unit 10 moves the second support arm 22*b* of the support/transfer section 22 before the droplet jet operation so that the suction section 21 does not prevent the droplet jet operation of the droplet jetting head 7 and locates the suction section 21 on the second support arm 22*b* to the non-facing position, that is, a standby position of the suction unit 21.

As shown in FIG. 1, the ink buffer tank 11 adjusts a liquid level (meniscus) of the ink at the nozzle tips using the difference in water head between the liquid level of the ink reserved in the ink buffer tank 11 and the nozzle surface 7*b* of the droplet jetting head 7. This prevents leakage of the ink and bad jet.

In the ink supply box 4, an ink tank 25 accommodating the ink is detachably attached. The ink tank 25 is connected to the droplet jetting head 7 through the supply pipe 26 with the ink buffer tank 11 interposed there between. In other words, the droplet jetting head 7 is supplied with the ink from the ink tank 25 through the ink buffer tank 11. As the ink, various types of ink, such as water-based ink, solvent ink, and UV curable ink are used. For example, the solvent ink is composed of various components including a pigment, a solvent (ink solvent), a dispersant, an additive, and a surfactant. Herein, to form a color filter frame, black ink is used. This frame is a light shielding area provided around a transmission area (RGB area) which transmits light.

In the pedestal 5, a control section 27, a memory section (not shown), and the like are provided. The control section 27 controls each member of the droplet jetting applicator 1, and the memory section stores various programs. The control section 27 performs based on the various programs a movement control of the Y-axis direction moving table 13, a movement control of the X-axis direction moving table 14, a movement control of the base plate 18, a drive control of the Z-axis direction transfer mechanism 19*a*, a drive control of the Y-axis direction transfer mechanism 19*b*, a drive control of the θ-direction rotation mechanism 19*c*, and the like. The relative position of the substrate 2 on the substrate holding table 15 with respect to the droplet jetting head 7 of the inkjet head unit 9 can be variously changed. Furthermore, the control section 27 based on the various programs performs a drive control of the shooting section 20 of the inkjet head unit 8, a movement control of the second support arm 22*b* of the support/transfer section 22, a drive control of the suction pump 23*c* of the exhaust section 23, and the like.

Next, a description is given of a droplet jet process and a cleaning process of the thus structured droplet jetting applicator 1. The control section 27 of the droplet jetting applicator 1 executes the droplet jet process and cleaning process based on the various programs. The cleaning process is periodically executed during the non-droplet jet operation including the wait for transportation of the substrate 2 or the operation of shooting the alignment marks on the substrate 2.

In the droplet jet process, first, the control section 27 drives and controls the Y-axis direction and X-axis direction transfer tables 13 and 14. The control section 27 furthermore drives and controls the shooting section 20 of the inkjet head unit 8 to shoot the alignment marks on the substrate 2 and adjust the position of the substrate 2 on the substrate holding table 15.

The control section 27 then drives and controls each member of the ink application box 3 for the droplet application operation to apply droplets to the substrate 2 on the substrate holding table 15. Specifically, the control section 27 drives and controls the Y-axis direction and X-axis direction transfer tables 13 and 14. The control section 27 also drives and controls the droplet jetting head 7 of the inkjet head unit 8 to perform the droplet jet operation to jet droplets to the substrate 2 as the application object by means of the droplet jetting head 7. The droplet jetting head 7 jets the ink from the nozzles 7*a* as droplets to land the droplets on the substrate 2 moving, thus forming dot rows in a predetermined pattern.

In the cleaning process, the control section 27 drives and controls the head maintenance unit 10 to move the second support arm 22*b* of the support/transfer section 22, locate the suction section 21 on the second support arm 22*b* to the facing position, and then drive the suction pump 23*c* of the exhaust 23. This gives the suction force to the suction section 21, and the suction section 21 sucks gas around the nozzle surface 7*b* of the droplet jetting head 7.

Thereafter, the control section 27 drives and controls the droplet jetting head 7 of the inkjet head unit 8 to perform the redundant jet operation to jet the ink as droplets. At this time, the droplet jetting head 7 continuously jets droplets from each nozzle 7*a* for several times. The jetted droplets are sucked by the suction section 21 and accommodated in the waste tank 23*b* through the exhaust pipe 23*a*. After such a maintenance operation, the control section 27 drives and controls the head maintenance unit 10 to move the second support arm 22*b* of the support/transfer section 22 so that the suction section 21 does not prevent the droplet jet operation of the droplet jetting head 7 and locate the suction section 21 on the second support arm 22*b* to the non-facing position, that is, the standby position of the suction section 21.

As described above, according to the embodiment of the present invention, the droplet jetting applicator 1 includes the suction section 21, which sucks the droplets jetted by the droplet jetting head 7 from the facing position, the support/transfer section 22, which supports the suction section 21, is movable together with the droplet jetting head 7, and moves the supported suction section 21 to the facing and non-facing positions, and the exhaust section 23, which evacuates the suction section 21 to give the suction force to the suction section 21. The suction section 21 can be therefore freely moved together with the droplet jetting head 7 by means of the support/transfer section 22 to the facing and non-facing positions. This eliminates the need, for example, to provide the suction section 21 in adjacent to the Y-axis direction guide plate 12 and extend the X-axis direction guide plate 17 so as to face the droplet jetting head 7 toward the suction section 21. It is therefore possible to prevent an increase in size of the droplet jetting applicator 1.

Furthermore, droplets are jetted from each nozzle 7*a* by the redundant jet operation of the droplet jetting head 7. Accordingly, coagulation of the ink at the tips of the nozzles 7*a* and clogging of the nozzles 7*a* are prevented. Moreover, the droplets jetted by the droplet jetting head 7 are sucked by the suction section 21 from the facing position. Accordingly, adherence of droplets splashed by the jet to the nozzle surface 7*b* of the droplet jetting head 7 is suppressed. The clogging of the nozzles 7*a* is thus prevented, and furthermore, the adherence of splashed droplets to the nozzle surface 7*b* is suppressed. It is therefore possible to prevent bad jet of droplets such as the non-jet and curved flight of droplets.

The suction section 21 is moved together with the droplet jetting head 7 by means of the support/transfer section 22. This allows the maintenance operation to be performed during the operation of shooting the alignment marks on the substrate 2. Accordingly, it is possible to shorten the standby time from a droplet application operation to the next droplet application operation. Moreover, the suction section 21 can move to the facing position within a short time by means of the support/transfer section 22. Accordingly, compared to the case where the suction section 21 is provided in adjacent to the Y-axis direction guide plate 12, the moving time to face the suction section 21 to the droplet jetting head 7 can be shortened.

Moreover, the suction section 21 includes the outer surface 24*b*, which faces the nozzle surface 7*b* from the facing position and includes a plurality of through holes 24*a* formed. Accordingly, the suction speed of the suction section 21 is uniformed, and the flow rate due to suction becomes constant. Accordingly, the splashed droplets can be surely sucked. Furthermore, it is possible to prevent the ink at the tips of the nozzles 7*a* from being locally dried within a short time. Moreover, the suction force of the suction section 21 can be less likely to vary even when the gap (distance) between the suction section 21 and the nozzle surface 7*b* of the droplet jetting head 7 somewhat varies.

Moreover, coated bodies, for example, such as color filters and black matrixes (color filter frames), are manufactured by using the aforementioned droplet jetting applicator 1 and jetting droplets to the substrate 2 as the application object. It is therefore possible to prevent manufacture defects of the coated bodies and provide high reliability of the application objects.

Other Embodiments

The present invention is not limited to the aforementioned embodiment, and various modifications can be made without departing from the scope of the invention.

For example, the single droplet jetting head 7 is provided in the aforementioned embodiment but not limited to this. A plurality of the droplet jetting heads 7 can be provided, and the number thereof is not limited.

In the aforementioned embodiment, the exhaust pipe 23*a* is connected to the bottom part of the side face of the suction section 21 but not limited to this. For example, the exhaust pipe 23*a* may be connected to the bottom face of the suction section 21. Furthermore, the suction section 21 is connected to the single exhaust pipe 23*a*, and the suction section 21 is evacuated by the suction pump 23*c* through the exhaust pipe 23*a* but not limited to this. The suction section 21 may be connected to two exhaust pipes 23*a*, through which the suction section 21 may be evacuated by the suction pump 23*c*.

What is claimed is:

1. A droplet jetting applicator comprising:

a table upon which an application object is placed;

a droplet jetting head which is movably provided so as to move along the table, the jetting head including a nozzle surface with a plurality of nozzles formed, through which droplets are jetted;

a suction section which receives and exhausts the droplets jetted from the plurality of nozzles, while sucking gas around the nozzle surface at a facing position opposite to the nozzle surface;

a support/transfer section which supports the suction section, freely moves together with the droplet jetting head, and moves the supported suction section to the facing position and a non-facing position which is apart from the facing position; and an exhaust section which evacuates the suction section to give the suction section a suction force.

2. The droplet jetting applicator according to claim 1, wherein the suction section includes an opening and an opposite surface having a plurality of through holes which face the nozzle surface through the opening at the facing position, and the exhaust section is connected to the suction section so as to suck the gas from the opening through the plurality of through holes of the opposite surface.

3. The droplet jetting applicator according to claim 2, wherein the suction section is configured so that an area of the opening is smaller than an area of the opposite surface.

4. A method of manufacturing a coated body, comprising:

preparing a droplet jetting applicator which includes:

a table upon which an application object is placed;

a droplet jetting head which is movably provided so as to move along the table and includes a nozzle surface with a plurality of nozzles formed, through which droplets are jetted;

a suction section which receives and exhausts the droplets jetted from the plurality of nozzles, while sucking gas around the nozzle surface at a facing position opposite to the nozzle surface;

a support/transfer section which supports the suction section, freely moves together with the droplet jetting head, and moves the supported suction section to the facing position and a non-facing position which is apart from the facing position; and an exhaust section which evacuates the suction section to give the suction section a suction force, jetting droplets from the droplet jetting head to the suction section;

exhausting the jetted droplets and gas around the nozzle surface by the suction section; and jetting droplets from the droplet jetting head to the application object placed on the table.

5. The method of manufacturing a coated body according to claim 4, wherein the suction section includes an opening and an opposite surface having a plurality of through holes which face the nozzle surface through the opening at the facing position, and the exhaust section is connected to the suction section so as to suck the gas from the opening through the plurality of through holes of the opposite surface.

6. The method of manufacturing a coated body according to claim 5, wherein the suction section is configured so that an area of the opening is smaller than an area of the opposite surface.

* * * * *